US005318163A

United States Patent [19]

Takemoto et al.

[11] Patent Number: 5,318,163

[45] Date of Patent: Jun. 7, 1994

[54] BALL CONVEYING GUTTER SYSTEM OF PACHINKO ISLAND

[75] Inventors: Takatoshi Takemoto, Tokyo; Toshikazu Chida, Tokto; Yoshihide Kurihara, Hanamaki, all of Japan

[73] Assignee: Kabushiki Kaisha Ace Denken, Tokyo, Japan

[21] Appl. No.: 993,988

[22] Filed: Dec. 21, 1992

[30] Foreign Application Priority Data

Dec. 20, 1991 [JP] Japan ..... 3-337362
Feb. 24, 1992 [JP] Japan ..... 4-036390

[51] Int. Cl.[5] ..... B65G 11/00
[52] U.S. Cl. ..... 193/2 R; 193/15; 273/121 B; 273/121 D
[58] Field of Search ..... 193/2 R, 15; 273/121 B, 273/121 D

[56] References Cited

U.S. PATENT DOCUMENTS 1,252,616 1/1918 Reif ..... 193/2 R
1,591,479 7/1926 Erickson ..... 193/2 R X

FOREIGN PATENT DOCUMENTS 0026931 2/1977 Japan ..... 273/121 B
0039432 3/1977 Japan ..... 273/121 D
0114339 9/1979 Japan ..... 273/121 B
0144232 11/1979 Japan ..... 273/121 D

*Primary Examiner*—Cheryl L. Gastineau
*Attorney, Agent, or Firm*—Lowe, Price, LeBlanc & Becker

[57] ABSTRACT

In a ball conveying gutter system, a gutter (21), (26) for carrying pachinko balls in order to supply them to the individual pachinko machines and for storing the pachinko balls is supported by successive gutter supports mounted respectively between successive pairs of confronting posts. Each gutter support has at opposite ends a pair of hooks, and the confronting posts of each pair have a pair of holes for detachably catching the opposite hooks respectively.

8 Claims, 8 Drawing Sheets

BALL CONVEYING GUTTER SYSTEM OF PACHINKO ISLAND

BACKGROUND OF THE INVENTION

1. Field of the Invention

This invention relates a ball conveying gutter system, for a pachinko island composed of a plurality of pachinko machines arranged in array, including a gutter extending in and through the pachinko island for carrying pachinko balls in order to supply them to the individual pachinko machines and for storing the pachinko balls.

2. Description of the Related Art:

This type of conventional ball conveying gutter system, for a pachinko island, is shown in FIGS. 9 and 10 of the accompanying drawings.

As shown in FIGS. 9 and 10, a plurality of successive pairs of confronting posts 1, 1 are mounted on the floor of a pachinko island 1*a*, and a gutter 2 extends through the successive pairs of confronting posts 1, 1, sloping longitudinally in and along the island 1*a*. The gutter 2 conveys pachinko balls from a ball tank 1*b* to the individual pachinko machines.

Between each pair of confronting posts 1, 1, a gutter support 3 is mounted for supporting the gutter 2. The gutter support 3 is secured to the confronting posts 1, 1 by means of screws 4, 4. In the pachinko island 1*a*, a bottom plate 2*a* of the gutter 2 has a flat upper surface or an inverted V-shape cross section.

However, in this conventional gutter system, since the gutter 2 only carries pachinko balls flowing there along and has a limited capacity which is not enough to enable the storing of the pachinko balls therein, the ball tank 1*b* is needed at the upper portion of the island 1*a*, which is expensive, and has the additional problem that it is difficult to secure an adequately large space for installation of such a ball tank.

Further, if a large quantity of pachinko balls flow into the gutter 2 at once, the gutter support 3 which has to bear the total weight of the gutter 2 and the pachinko balls flowing therein is relatively unstable structurally as it is only attached to the confronting posts 1, 1 by the screws 4, 4. To adjust the height of the gutter 2, the screws 4, 4 are removed and then the gutter support 3 is moved to a desired position, whereupon the gutter support 3 is secured again to the confronting posts 1, 1 by the screws 4, 4, which is laborious and time-consuming.

Furthermore, assuming that a lot of pachinko balls flow in the gutter 2, since the bottom plate 2*a* of the gutter 2 has a flat upper surface, the pachinko balls are apt to gather at one side rather than across the whole width so that the pachinko balls cannot be supplied uniformly to the pachinko machines on both sides of the gutter 2 and so that the overall flow of pachinko balls will possibly be retarded, thus resulting in inefficient conveying of pachinko balls. Consequently it was difficult to convey a large quantity of pachinko balls even if the gutter has a large capacity.

SUMMARY OF THE INVENTION

It is therefore an object of this invention to provide a ball conveying gutter system, for a pachinko island, which enables cost reduction, an increased supporting strength of a gutter and a simple and quick operation of adjusting the height of the gutter.

Another object of the invention is to provide a ball conveying gutter system, for a pachinko island, which includes an increased-capacity gutter for storing pachinko balls therein, thus conveying pachinko balls effectively.

According to a first aspect of the invention, there is provided a ball conveying gutter system, for a pachinko island composed of a plurality of pachinko machines arranged in array, including a gutter extending in and along the pachinko island for carrying pachinko balls in order to supply them to the individual pachinko machines, wherein the gutter includes a pair of opposite vertical side plates and a bottom plate extending along and between the side plates, the bottom plate having an upper surface convexly formed.

The gutter may be divided into a plurality of successive troughs having a predetermined length and adapted to be connected with one to another.

Each of the troughs may be formed from a rectangular flat iron sheet, whose opposite marginal portions are bent, as the side plates, initially so as to be inclined inwardly and are then secured to a pair of fixed vertical support plates, respectively, so as to upwardly curve a central portion between the opposite marginal portions.

According to a second aspect of the invention, there is provided a ball conveying gutter system for a pachinko island composed of a plurality of pachinko machines arranged in array, comprising: a plurality of successive pairs of confronting posts adapted to be mounted on the floor of the pachinko island; a gutter support adapted to be detachably mounted between each of the pairs of confronting posts; and a gutter extending in and along the pachinko island for carrying pachinko balls in order to supply them to the individual pachinko machines and for storing the pachinko balls, the gutter assuming an inclined posture on the gutter support between each pair of confronting posts; the gutter support having a pair of hooks at opposite ends, the confronting posts of each pair having a pair of holes for removably catching the hooks, of the gutter support.

One of the pair of holes may be a selected one of a vertical succession of holes in and along each of the confronting posts of each pair, whereby the height of the gutter may be adjusted by selecting an arbitrary pair, from the successive pairs of holes of the confronting posts of the individual pair, to catch the respective hooks of the associated gutter support.

The gutter may include a pair of opposite vertical side plates and a bottom plate extending along and between the side plates, the bottom plate having an upper surface convexly formed.

The gutter may be formed from a rectangular flat iron sheet, whose opposite marginal portions are bent, as the side plates, initially so as to be inclined inwardly and are then caused to assume a vertical posture so as to curve a central portion, as the bottom plate, upwardly between the opposite marginal portions by bringing the opposite marginal portions into engagement with the confronting posts of each pair.

The gutter may be divided into a plurality of successive troughs having a predetermined length and adapted to be connected with one another.

With this arrangement, the pachinko balls brought to the top portion of the pachinko island are stored in the large-capacity gutter extending through the successive pairs of confronting posts and slanting longitudinally and flow along the gutter so as to be conveyed to the individual pachinko machines as they are needed. The gutter is supported on the successive gutter supports each detachably mounted between each of the successive pairs of confronting posts.

Each gutter support has at opposite ends a pair of hooks to be caught by the corresponding pair of holes of the associated pair of confronting posts, to thus hold the gutter firmly. Because of its increased supporting strength, the gutter supports can stably bear even an increased total weight of the gutter and the pachinko balls stored therein.

Since the hooks of the individual gutter support can be detached from the catching holes of the confronting posts simply, it is possible to install and remove the gutter without difficulty. Given that each post has a vertical succession of catching holes, it is possible to adjust the height of the gutter support simply by selecting an arbitrary pair from the successive pairs of catching holes of the confronting posts as required.

Because the upper surface of the bottom plate extending between the opposite vertical side plates of the gutter is convexly formed, plenty of pachinko balls flowing in the gutter tend to move toward the opposite side plates from the central curved surface so that they will be smoothly conveyed toward the downstream end in and along the gutter.

For example, the gutter may be formed from a rectangular flat iron sheet; the opposite marginal portions of the flat blank iron sheet are bent, as the side plates, initially so as to be inclined inwardly and are then caused to assume a vertical posture so as to curve a central portion, namely the bottom plate, between the opposite marginal portions upwardly, by bringing the vertical side plates into engagement with the respective confronting posts of each pair.

If the gutter is divided into a plurality of successive troughs having a predetermined length and adapted to be connected with one another, it is possible to mount the gutter on the successive gutter supports simply and accurately.

DETAILED DESCRIPTION

Figure 1:
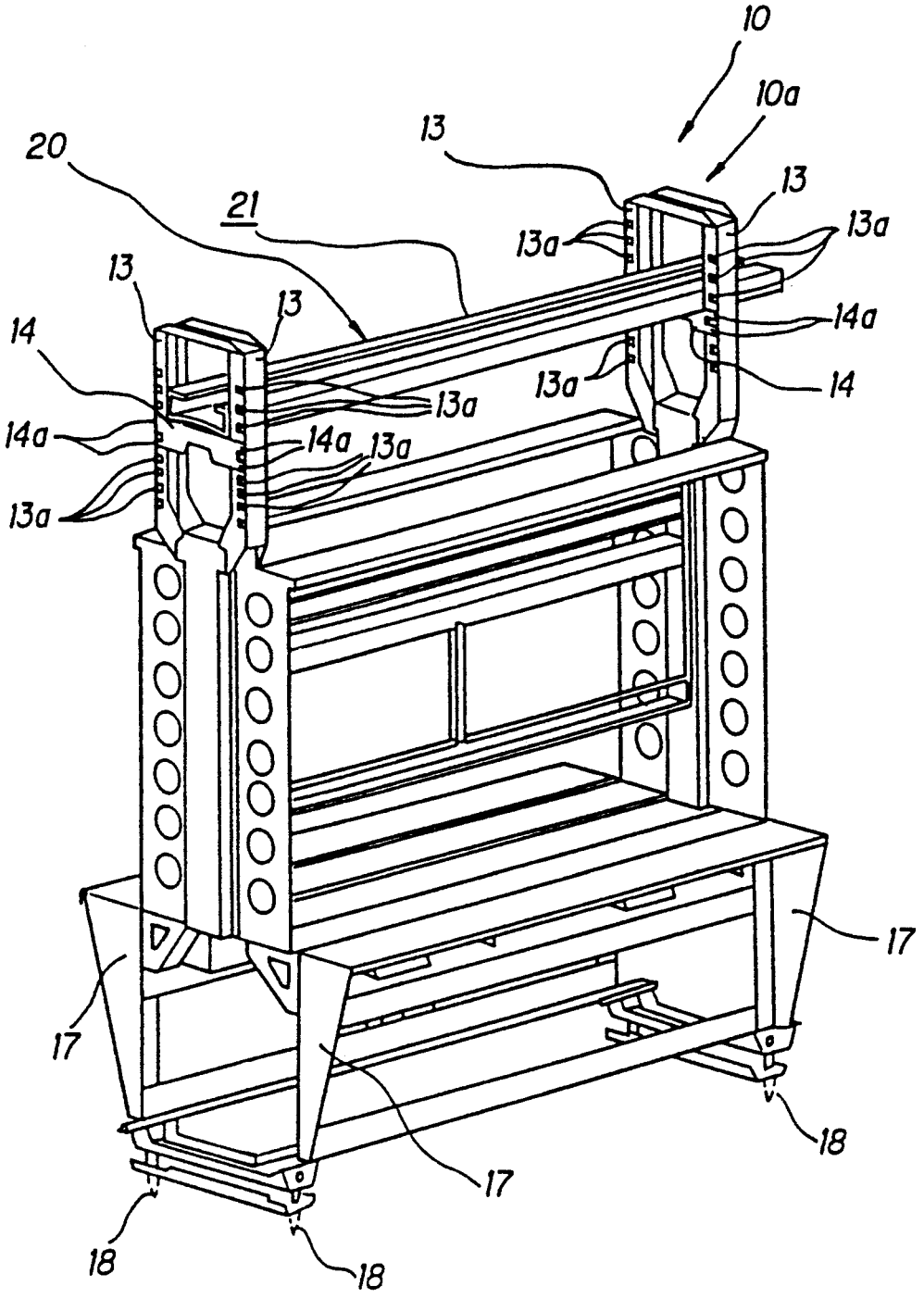
FIG. 1 is a perspective view showing a support frame unit, for a pachinko island, in which a ball conveying gutter system according to a first embodiment of this invention is incorporated.

Various embodiments of this invention will now be described with reference to the accompanying drawings. Like reference numerals designate similar elements or parts through several views, and any repetition of description is omitted.

FIGS. 1 through 7 show a first embodiment of the invention.

Figure 2:
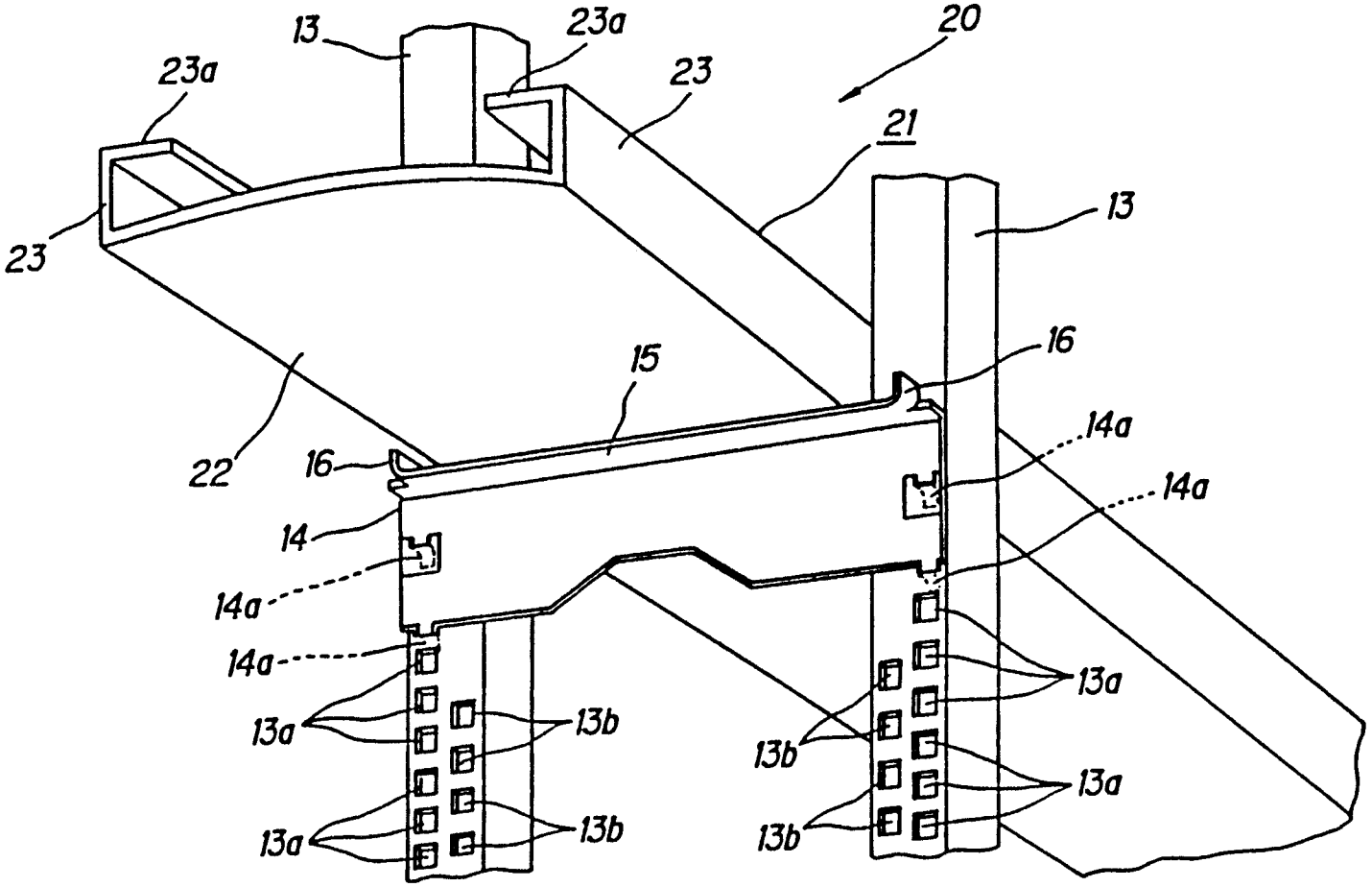
FIG. 2 is a fragmentary perspective view showing the main portion of the ball conveying gutter system of the first embodiment.
Figure 3:
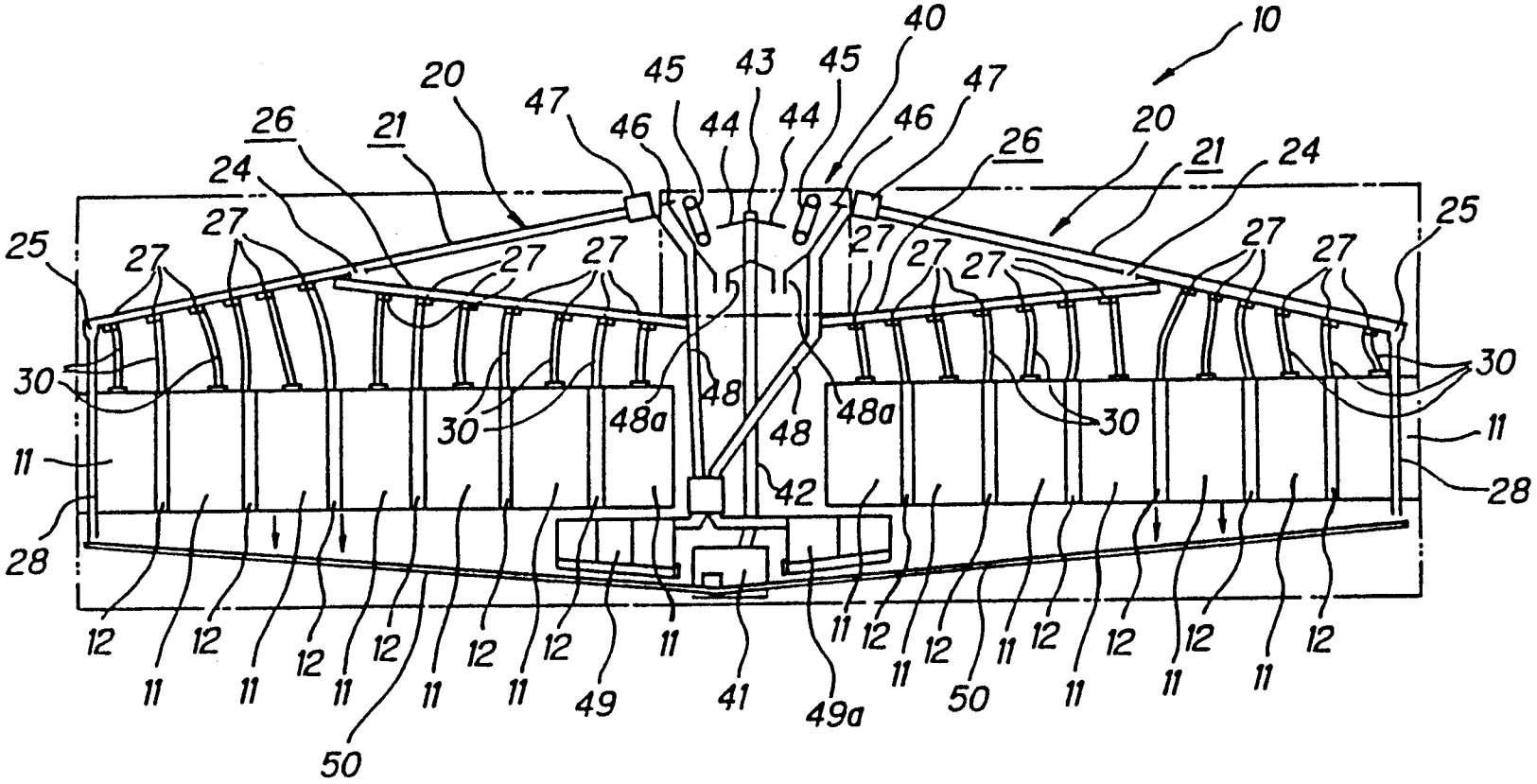
FIG. 3 is a front view showing the pachinko island in which the ball conveying gutter system of the first embodiment is incorporated.

As shown in FIGS. 1 through 3, in a pachinko island 10 composed of a plurality of pachinko machines 11, 11 arranged in array, there are installed on the floor of an amusement arcade a succession of support frame units 10*a* each for supporting a pair of pachinko machines facing in opposite directions. Each support frame unit 10*a* includes a plurality of successive pairs of confronting posts 13, 13. Each post 13 has a base frame 17 equipped with anchor bolts 18 adapted for securing the post 13 to the floor.

In and along the upper portion of the pachinko island 10, there is installed a ball conveying gutter system 20 for storing pachinko balls and distributing them to the individual pachinko machines 11 and a plurality of ball dispensers 12 each sandwiched between the adjacent pachinko machines 11. The ball conveying gutter system 20 comprises a plurality of successive pairs of confronting posts 13, 13 of the pachinko island 10, a plurality of successive gutter supports 14 each adapted to be detachably mounted between each pair of confronting posts 13, 13, and upper and lower gutters 21, 26 adapted to be supported in slant postures on the gutter supports 14 between the successive pairs of confronting posts 13, 13.

Each gutter support 14 for supporting the upper gutter 21 between the associated pair of confronting posts 13, 13 has at opposite ends a pair of hooks 14*a*, 14*a*, respectively. Each of the confronting posts 13 of the individual pair has a vertical succession of holes 13*a*, an arbitrary one of which may be selected to detachably catch one of the hooks 14*a* of each gutter support 14.

Partly since each of the confronting part of posts 13 has the vertically successive holes 13*a*, and partly since each hook 14*a* of the gutter support 14 can be detachably caught in a selected one of the vertically successive holes 13*a* of the associated post 13, it is possible to adjust the height of the gutter support 14 simply by shifting the gutter support 14 vertically from one pair of holes 13*a*, 13*a* to another. Likewise, though illustration is omitted, the lower gutter 26 situated below the upper gutter 21 is supported between the confronting posts 13, 13 via the gutter support 14.

More specifically, as shown in FIG. 2, each of the opposite ends of the individual gutter support 14 has upper and lower hooks 14*a*, 14*a* bent slanting downwardly. The distance between the upper and lower hooks 14*a*, 14*a* of each end of the gutter support 14 is equal to the pitch of the successive holes 13*a* of the associated post 13.

Further, the gutter support 14 has a gutter-receptacle portion 15 engageable with a bottom plate 22 of the upper gutter 21 and having a pair of turnovers 16, 16 bent upwardly from its opposite ends for preventing the upper gutter 21 from being displaced. Each of the confronting posts 13 of the individual pair has an additional vertical succession of holes 13*b* inwardly of the successive holes 13*a*.

As shown in FIG. 3, in the central lower portion of the pachinko island 10 there is installed a lower tank 41 communicating with the downstream end of each of a pair of collection gutters 50, 50 for collecting balls which have missed the scoring hole from the individual pachinko machines 11. Above the lower tank 41 there is a ball polishing and raising unit 40.

Above the lower tank 41 there is a raising pipe 42 in which a rotatable part of the ball polishing and raising unit 40 is mounted. On each side of an upper end 43 of the raising pipe 42, there are an inner drainboard 44, a lift 45 and an outer drainboard 46 so that pachinko balls discharged from the raising pipe 42 are distributed to the gutter system 20, 20 on opposite sides of the upper portion of the island.

Under the inner drainboard 44 and the lift 45, there is a supply port 48*a* for circulating polishing pieces, which are to be collected separately from pachinko balls, to the lower tank 41. To the downstream side of each outer slanting drainboard 46, there is connected a gutter plate 47 for directing pachinko balls to the upper upstream end of the upper gutter 21 of the respective ball conveying gutter system 20.

Under and between the outer drainboard 46 and the gutter plate 47, there is a vertical overflow pipe 48 which receives overflow pachinko balls and allows them to flow downwardly. Each overflow pipe 46 communicates at its lower end with a preliminary tank 49, 49*a*.

The upper gutter 21 for conveying pachinko balls to the individual pachinko machines 11 and the individual ball dispensers 12 slopes from its upstream end near the ball polishing and raising unit 40 to its downstream end situated at the end of the island.

On the lower side of the substantially central portion of the upper gutter 21, there is situated the upstream end of the lower gutter 26 sloping down and connected at its downstream end to the overflow pipe 48 positioned perpendicularly under the upstream end of the upper gutter 21.

The bottom plate of the upper gutter 21 has in its one side a ball supply hole 24 through which pachinko balls stored in the upper gutter 21 fall down to the upstream end of the lower gutter 26. In the other side, the bottom plate of the upper gutter 21 has a ball return hole 25 through which excessive pachinko balls are returned to the lower portion of the island via a ball circulating pipe 28.

The upper gutter 21 has a succession of ball supply ports 27 ranging from its substantially central portion to its downstream end for supplying pachinko balls to the individual pachinko machines 11 and the individual ball dispensers 12 as they are needed. Likewise, the lower gutter 26 has a succession of ball supply ports 27 ranging from its upstream end to its downstream end for supplying pachinko balls to the individual pachinko machines 11 and the individual ball dispensers 12 as they are needed.

Each ball supply port 27 is equipped with a chute which is connected at its downstream end to the individual pachinko machine 11 or the individual ball dispenser 12 by means of concertinaed tube 30 for passage of pachinko balls.

Figure 4:
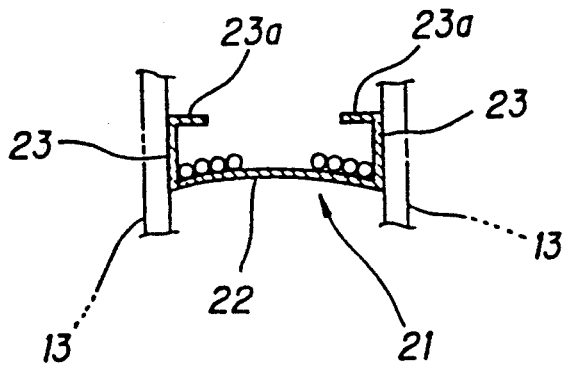
FIG. 4 is a cross-sectional view showing an upper gutter of the ball conveying gutter system of the first embodiment.
Figure 5:
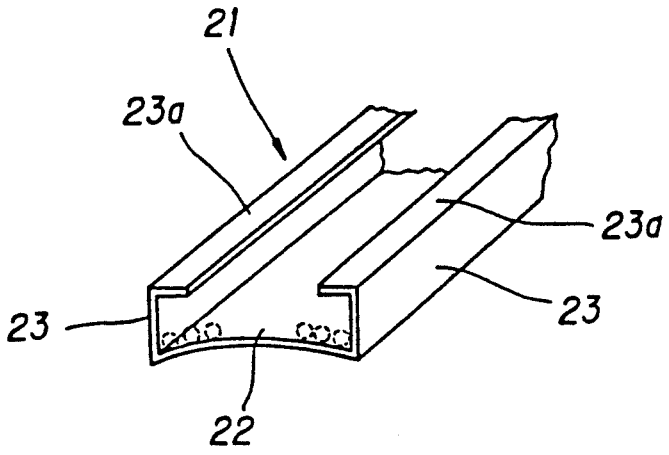
FIG. 5 is a fragmentary perspective view of the upper gutter of FIG. 4.

As shown in FIGS. 4 and 5, the bottom plate 22 between the opposite vertical side plates 23, 23 of the upper gutter 21 has an upper surface convexly formed. Though there is no illustration in the views, the lower gutter 26 has the same cross-sectional shape as the gutter 21. The opposite side plates 23, 23 have a pair of flanges 23*a*, 23*a* inwardly projecting from the upper edges.

In FIG. 3, pachinko balls used in the individual pachinko machine 11 are discharged to the collection gutter 50 and flow in and along the collection gutter 50 to the lower tank 41. Then a ball polishing and raising unit 40 conveys, while polishing, the pachinko balls to the upper portion of the island, whereupon the pachinko balls are distributed to the ball conveying gutter systems 20, 20 on opposite sides of the polishing and raising unit 40.

In operation, the pachinko balls conveyed to the upstream end of the upper gutter 21 from the polishing and raising unit 40 via the gutter plates are retained and stored in the sloping upper gutter 21 supported between the successive pairs of confronting posts 13, 13, as shown in FIGS. 1 and 2. Also the pachinko balls pass an intermediate portion, under which the upstream end of the lower gutter 26 is positioned, and are conveyed to the downstream end of the upper gutter 21.

Since the upper gutter 21 serves not only to carry pachinko balls flowing therein but also to store the pachinko balls, it is not necessary to install any ball tank at the upper portion of the island and hence to secure any space for installation of such a ball tank, thus reducing the cost of production.

Meanwhile, the pachinko balls which fall on the lower gutter 26 from the ball supply hole 24 of the upper gutter 21 flow from the upstream end of the lower gutter 26 to the downstream end. Thus the pachinko balls conveyed by the upper and lower gutters 21, 26 are distributed to the individual pachinko machine or the individual ball dispenser 12 from the corresponding supply port 27 via the concertinaed tube 30 as they are needed.

The upper gutter 21 is received on the gutter-receptacle portions 15 of the gutter supports 14 each detachably mounted between each of the successive pair of confronting posts 13, 13. Since the opposite hooks 14*a*, 14*a* of the individual gutter support 14 are caught in the respective holes 13*a*, 13*a* of the confronting posts 13, 13, it is possible to attach the gutter support 14 at opposite ends to the confronting posts 13, 13 with improved firmness.

Thus since the upper gutter 21 is supported with improved firmness, it can receive the gutter supports 14 stably even when pachinko balls are stored in the upper gutter 21 increasing the total weight. At that time, the opposite turnovers 16 of the gutter-receptacle portion 15 service prevent the upper gutter 21 from being displaced laterally. As the lower gutter 26 is similar in construction and operation with the upper gutter 21, the detailed description of the lower gutter 26 is omitted in the following description.

Since the hooks 14*a* of the gutter support 14 can be detached from the catching holes 13*a* of the confronting posts 13 with ease, it is possible to facilitate installation and removal of the upper gutter 21 in a simple operation. Further, since each post 13 has a vertical succession of holes 13*a* each for catching the hook 14*a*, so that the position of the gutter support 14 can be shifted vertically as needed, adjusting the height of the upper gutter 21 is easily carried out.

As shown in FIGS. 4 and 5, since the bottom plate 22 of the upper gutter 21 has an upper surface which is convexly formed, pachinko balls are distributed to opposite sides from the central curved surface as plenty of pachinko balls are received on the upper gutter 21 from the polishing and raising unit 40, and flow downwardly in and along the upper gutter 21 to its lower end smoothly without jamming, thus causing efficient conveying.

Figure 6:
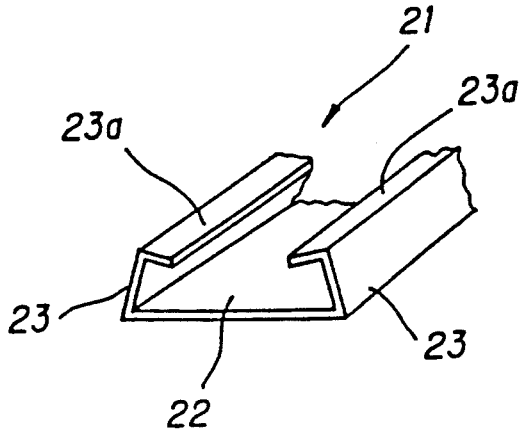
FIG. 6 is a fragmentary perspective view of the upper gutter assuming a semifinished form, illustrating how the upper gutter is made.
Figure 7:
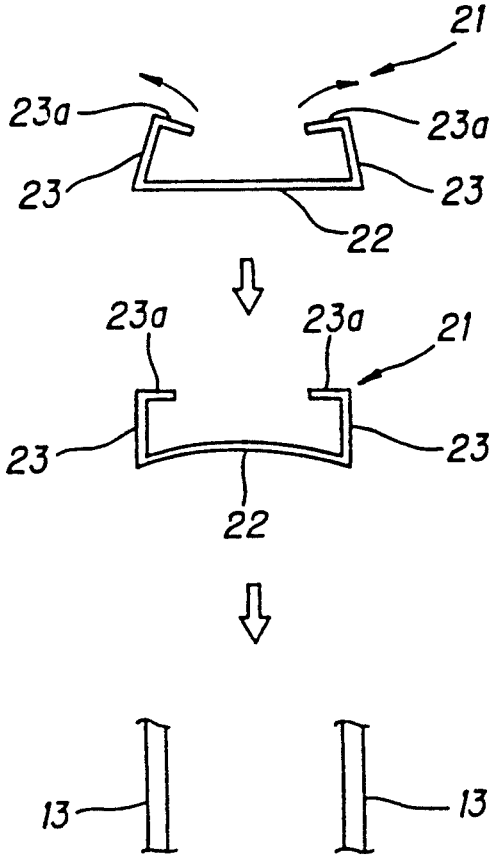
FIG. 7 illustrates the manner in which the upper gutter of the ball conveying gutter system of the first embodiment is formed.

The upper gutter 21 having the cross-sectional shape of FIGS. 6 and 7 may be simply made from a flat iron sheet. Specifically, as shown in FIG. 6, the opposite edge portions of the flat iron sheet are bent, as the opposite vertical side plates 23, 23 of the upper gutter 21, so as to be inclined inwardly. Then, as shown in FIG. 7, the opposite side plates 23, 23 are caused to assume a vertical posture so as to curve a central portion of the bottom plate 22 of the upper gutter 21, between the opposite side plates 23, 23 upwardly, and are brought into engagement with the confronting posts 13, 13 of each pair with the bottom plate 22 kept in the curved posture.

Figure 8:
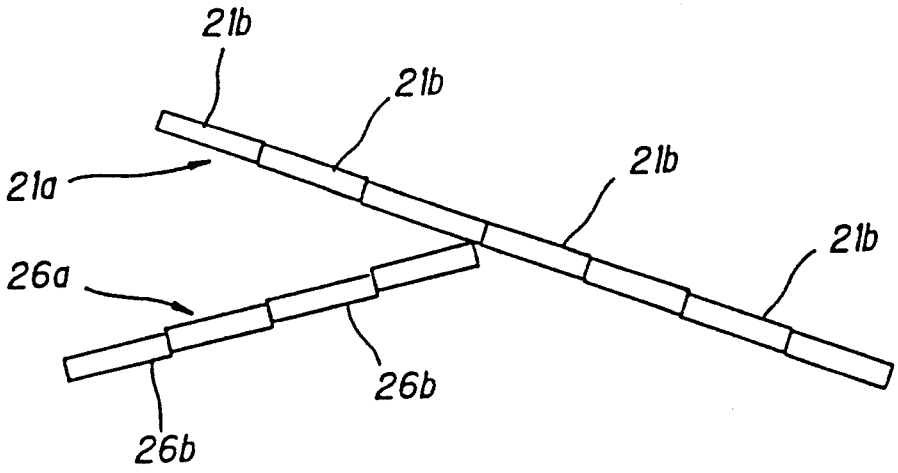
FIG. 8 is a front view showing upper and lower gutters of a modified gutter system according to a second embodiment.
Figure 9:
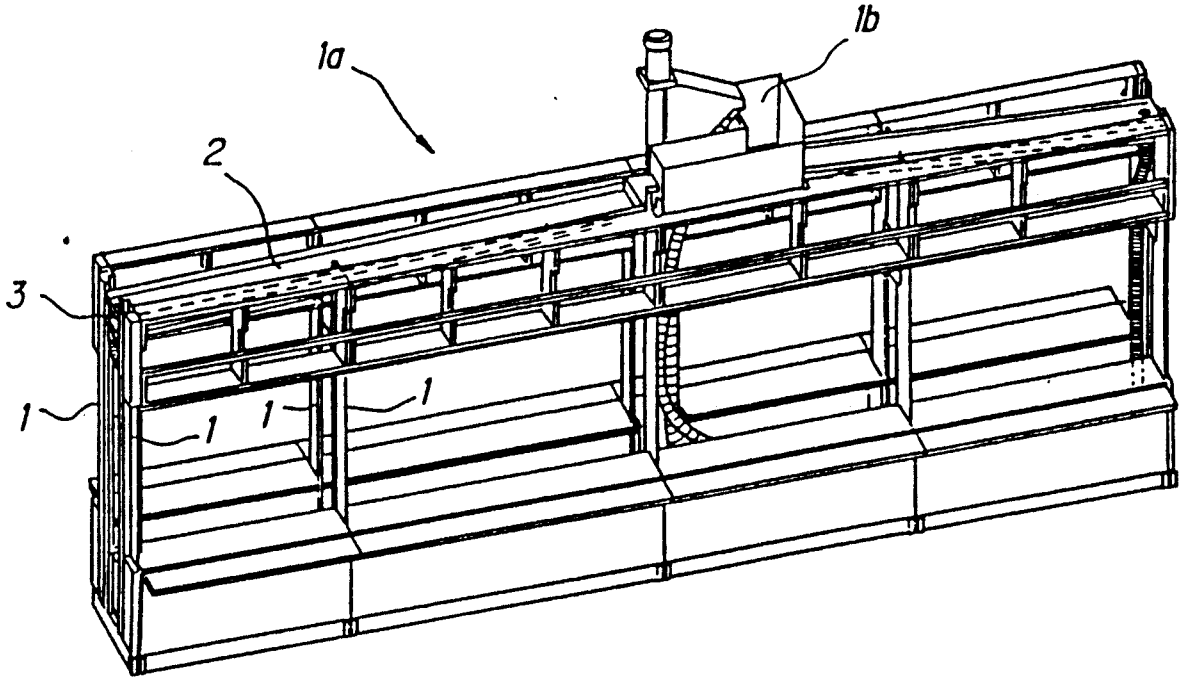
FIG. 9 (PRIOR ART)
FIG. 9 is a perspective view of a pachinko island in which a conventional gutter system is incorporated.
Figure 10:
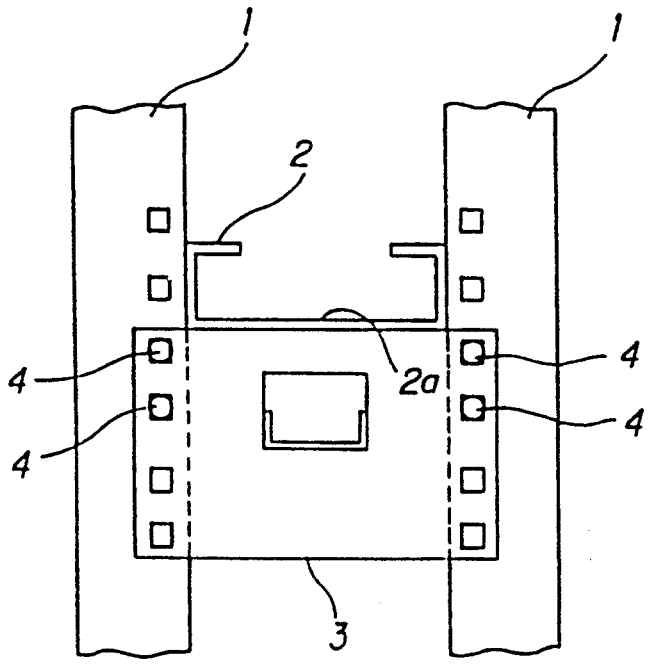
FIG. 10 (PRIOR ART)
FIG. 10 is a fragmentary enlarged front view of the conventional gutter system.

FIG. 8 shows a second embodiment of the invention.

In this embodiment, as shown in FIG. 8, each of the upper and lower gutters 21*a*, 26*a* is divided into a succession of troughs 21*b*, 26*b* of a predetermined length.

The troughs 21*b* are connected with one another successively to form the upper gutter 21*a*, and the troughs 26*b* are connected with one another successively to form the lower gutter 26*a*.

With this arrangement, it is possible to mount each of the upper and lower gutters 21*a*, 26*a* on the gutter supports 14 between each successive pair of confronting posts 13, 13.

In the second embodiment, both the upper and lower gutters are divided into a plurality of interconnectable troughs of a predetermined length. Alternatively only one of the upper and lower gutters may be divided into a plurality of interconnectable troughs.

Further, in the foregoing embodiments, either the bottom plate of the upper gutter or that of the lower gutter has an upper surface which is convexly formed. Alternatively the bottom plate of the upper gutter and/or that of the lower gutter may have a different transverse cross-sectional shape such as a planar rectangle.

According to the ball conveying gutter system of this invention, partly since pachinko balls are stored in the gutter for conveying the pachinko balls to the individual pachinko machines, and partly since the opposite hooks of the individual gutter support is detachably caught by the holes of each of the successive pair of confronting posts, it is possible to reduce the cost of production and to increase the strength of the gutter support, thus enabling a simple and quick gutter installation and removing operation. If each of the confronting posts has a vertical succession of holes, it is possible to catch the gutter support by a selected pair of holes of the confronting posts so that the height of the gutter to be supported by the gutter support can be adjusted simply and quickly.

Further, if the bottom plate of the gutter has an upper surface which is convexly formed, pachinko balls are distributed over the entire width of the bottom plate of the gutter as they flow in the gutter, and hence can be conveyed with improved efficiency. Furthermore, if the gutter is divided into a plurality of successive troughs, of a predetermined length, to be interconnected with one another, it is possible to install the gutter on the gutter support between the confronting posts accurately and simply.

What is claimed is:

1. A ball conveying gutter system, for a pachinko island composed of a plurality of pachinko machines arranged in array, including a gutter extending in and along the pachinko island for carrying pachinko balls in order to supply them to the individual pachinko machines, wherein said gutter includes a pair of opposite vertical side plates and a bottom plate extending along and between said side plates, said bottom plate having an upper surface which is convexly formed across its width.

2. A ball conveying gutter system according to claim 1, wherein said gutter is divided into a plurality of successive troughs each having a predetermined length and adapted to be connected with one another.

3. A ball conveying gutter system for a pachinko island composed of a plurality of pachinko machines arranged in array, including a gutter extending in and along the pachinko island for carrying pachinko balls in order to supply them to the individual pachinko machines, wherein said gutter includes a pair of opposite vertical side plates and a bottom plate extending along and between said side plates, said bottom plate having an upper surface which is convexly formed across its width, wherein said gutter is divided into a plurality of successive troughs each having a predetermined length and adapted to be connected with one another, and wherein each of said troughs is formed from a rectangular flat iron sheet, whose opposite edge portions are bent, as said side plates, initially so as to be inclined inwardly and are then secured to a pair of fixed vertical support plates, respectively, so as to upwardly curve a central portion between said opposite edge portions.

4. A ball conveying gutter system for a pachinko island composed of a plurality of pachinko machines arranged in array, comprising:

(a) a plurality of successive pairs of confronting posts adapted to be mounted on a floor of the pachinko island;

(b) a gutter support adapted to be detachably mounted between each of said pairs of confronting posts; and (c) a gutter extending in and along the pachinko island for carrying pachinko balls in order to supply them to the individual pachinko machines and for storing the pachinko balls, said gutter assuming an inclined posture on said gutter support between each said pair of confronting posts;

(d) said gutter support having a pair of hooks at opposite ends, said confronting posts of each pair having a pair of holes for removably catching said hooks, respectively, of said gutter support.

5. A ball conveying gutter system according to claim 4, wherein one of said pair of holes is a selected one of a vertical succession of holes in and along each of said confronting posts of each said pair, whereby the height of said gutter may be adjusted by selecting an arbitrary pair, from the successive pairs of holes of said confronting posts of the individual pair, to catch the respective hooks of the associated gutter support.

6. A ball conveying gutter system according to claim 4, wherein said gutter includes a pair of opposite vertical side plates and a bottom plate extending along and between said side plates, said bottom plate having an upper surface convexly formed across its width.

7. A ball conveying gutter system according to claim 6, wherein said gutter is formed from a rectangular flat iron sheet, whose opposite edge portions are bent, as said side plates, initially so as to be inclined inwardly and are then caused to assume a vertical posture so as to upwardly curve a central portion, as said bottom plate, between said opposite edge portions, said vertical side plates being engaged respectively with said confronting posts of each said pair, said bottom plate being supported on said gutter support.

8. A ball conveying gutter system according to claim 4, wherein said gutter is divided into a plurality of successive troughs having a predetermined length and adapted to be connected with one to another.

* * * * *